US008468653B2

(12) United States Patent
Tumler

(10) Patent No.: US 8,468,653 B2
(45) Date of Patent: Jun. 25, 2013

(54) ACTUATING DRIVE FOR A MOVABLE FURNITURE PART

(75) Inventor: Klaus Tumler, Lauterach (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/324,195

(22) Filed: Dec. 13, 2011

(65) Prior Publication Data

US 2012/0079684 A1 Apr. 5, 2012

Related U.S. Application Data

(63) Continuation of application No. PCT/AT2010/000192, filed on Jun. 1, 2010.

(30) Foreign Application Priority Data

Jul. 28, 2009 (AT) ..... A 1178/2009

(51) Int. Cl.
*E05F 1/08* (2006.01)

(52) U.S. Cl.
USPC ..... 16/286; 16/289; 49/246; 312/319.2; 312/325

(58) Field of Classification Search
USPC ..... 16/286–289, 370, 371, 321, 322, 16/324, 325, 327; 49/246, 254, 386; 312/322–325, 319.2, 319.1, 319.4
See application file for complete search history.

(56) References Cited

U.S. PATENT DOCUMENTS

| | | | | |
|---|---|---|---|---|
| 7,178,202 | B2 * | 2/2007 | Hirtsiefer et al. | 16/366 |
| 7,500,287 | B2 * | 3/2009 | Brustle | 16/286 |
| 7,562,757 | B2 * | 7/2009 | Dubach et al. | 192/215 |
| 7,966,699 | B2 * | 6/2011 | Dubach et al. | 16/386 |
| 8,056,991 | B2 * | 11/2011 | Hollenstein | 312/312 |
| 2001/0039762 | A1 * | 11/2001 | Giovannetti | 49/246 |
| 2004/0239213 | A1 * | 12/2004 | Hirtsiefer | 312/109 |
| 2008/0209682 | A1 | 9/2008 | Dubach et al. | |

FOREIGN PATENT DOCUMENTS

| | | |
|---|---|---|
| DE | 2 102 653 | 8/1972 |
| DE | 27 52 186 | 6/1979 |
| WO | 2007/041736 | 4/2007 |
| WO | 2009/108971 | 9/2009 |
| WO | 2010/057230 | 5/2010 |

OTHER PUBLICATIONS

International Search Report issued Feb. 11, 2011 in International (PCT) Application No. PCT/AT2010/000192.
Austrian Patent Office Search Report issued Apr. 19, 2010 in Austrian Patent Application No. A 1178/2009.

* cited by examiner

*Primary Examiner* — William L. Miller
(74) *Attorney, Agent, or Firm* — Wenderoth, Lind & Ponack, L.L.P.

(57) ABSTRACT

An actuating drive includes at least one actuating arm for moving a movable furniture part, and a locking device for blocking the motion of the actuating arm. The locking device permits the motion of the actuating arm only after the movable furniture part has been mounted on the actuating arm, and the locking device is released by the mounting of the movable furniture part on the actuating arm.

19 Claims, 5 Drawing Sheets

ACTUATING DRIVE FOR A MOVABLE FURNITURE PART

This application is a Continuation of International Application No. PCT/AT2010/000192, filed Jun. 1, 2010, the entire disclosure of which is incorporated herein by reference.

BACKGROUND OF THE INVENTION

The present invention relates to an actuating drive comprising at least one actuating arm for moving a movable furniture part, and a locking device for blocking a movement of the actuating arm.

The invention further concerns an article of furniture having an actuating drive of the kind to be described.

Such actuating drives having a locking device for blocking an actuating arm movement are used in particular for moving furniture flaps which are mounted movably in respect of height relative to a furniture carcass. More specifically, such actuating drives also have a spring device for compensating for the weight of the furniture flap, which at the carcass side pressurizes a pivotally mounted actuating arm in the opening direction. Critical moments can particularly occur in situations in which the furniture flap is not yet connected to the actuating arm, as the flap-less or "empty" actuating arm can be urged in the closing direction, starting from the completely open position, against the force of the spring device. If now due to carelessness the flap-less actuating arm slips out of the hand of the fitter in an intermediate position, then the actuating arm kicks up again with a tremendous force due to the force of the spring device acting thereon and in that case can cause serious injury to the fitting personnel or can cause other damage. A possible way of blocking the movement of the actuating arm is described for example in WO 2007/041736 A1, wherein the axis of rotation at the flap side of the actuating arm can be arrested by a locking portion which is to be operated manually.

SUMMARY OF THE INVENTION

It is therefore an object of the present invention to propose a blocking of the actuating arm which is easier to implement and, in particular, to propose a simple unlocking of the locking device.

According to the invention, that is attained by the features described below. Further advantageous configurations of the invention are also described.

It is therefore provided that the locking device for blocking a movement of the actuating arm allows a movement of the actuating arm only after the movable furniture part has been mounted to the actuating arm, wherein unlocking of the locking device is effected by mounting of the movable furniture part to the actuating arm.

In other words, unlocking of the locking device is brought about only when the movable furniture part has been properly connected to the actuating arm. In that case, unlocking can occur automatically in the course of the mounting procedure without in that respect locking portions which are to be actuated manually having to be moved into an arresting or into a release position, respectively. Preferably automatic locking of the actuating arm also occurs when the movable furniture part is completely removed from the actuating arm again.

In a preferred embodiment of the invention, the actuating arm can have a mounting portion which can be releasably connected by way of a fixing device to a fitment body which is to be fixed to the movable furniture part and which is preferably pre-mounted, and the mounting portion can be mounted preferably without the use of a tool and/or removed preferably without a tool. Such fixing devices are basically already used in accordance with the state of the art, wherein the mounting portion associated with the actuating arm can be latched without the use of a tool and/or dismantled without the use of a tool by way of a mechanical latching connection, to a fitment body which is pre-mounted to the movable furniture part. In that case, the mechanical latching connection can be in the form of a snap-action connection with a spring-loaded latching portion which makes a releasable connection between the mounting portion and the fitment body. That snap-action connection can be released again by applying pressure to the spring-loaded latching portion. The mounting portion is preferably mounted at the free end of the actuating arm and is connected thereto pivotally by way of a pivot bearing.

In one embodiment, the locking device can have at least one movably mounted control portion which, upon mounting of the mounting portion to the fitment body, can be acted upon thereby. In other words, when mounting the mounting portion to the fitment body, a movement of the control portion is triggered, wherein that movement can be transmitted by way of a transmission mechanism to a locking portion, and a pivotal movement of the actuating arm can be blocked by the locking portion.

In another possible embodiment, the control portion can be mounted pivotally to the mounting portion. In that respect, it may be desirable if the transmission mechanism converts a pivotal movement of the control portion into a linear movement of the locking portion. In a structurally simple solution, the transmission mechanism can have a lever mechanism, which is preferably two or more hingedly interconnected levers.

In a preferred embodiment of the invention, the locking portion intended for blocking the actuating arm can be urged in the direction of the arresting position by a spring device. In other words, the pre-stressed locking portion is continuously urged in the direction of the arresting position and can preferably be released from the actuating arm only by flap mounting. If therefore the movable furniture part is completely removed from the actuating arm, automatic blocking of the actuating arm in a pivotal position can be afforded by the spring-loaded locking portion.

In a preferred embodiment, the actuating arm can have at least one recess into which the locking portion can engage. The at least one recess can be provided or arranged in an edge surface of the actuating arm, and can extend at least partially in the radial direction relative to the pivot bearing at the flap side, which connects the actuating arm to the mounting portion.

In a possible embodiment, the mounting portion can be blocked with play relative to the actuating arm in the locked position of the locking device. That provides that the mounting portion is not completely rigid relative to the actuating arm but is held to the actuating arm in the locked position with some clearance. In that way, latching between the fitment body which is pre-mounted to the furniture flap and the mounting portion of the actuating arm is made easier.

In order to compensate for the weight of the movable furniture part, a spring device can be provided by which the actuating arm is or can be urged in the opening direction about an axis of rotation at the carcass side.

The article of furniture according to the invention has at least one actuating drive of the kind in question.

BRIEF DESCRIPTION OF THE DRAWINGS

Further details and advantages of the present invention are described with reference to the specific description hereinafter, in which.

DETAILED DESCRIPTION OF THE INVENTION

Figure 1:
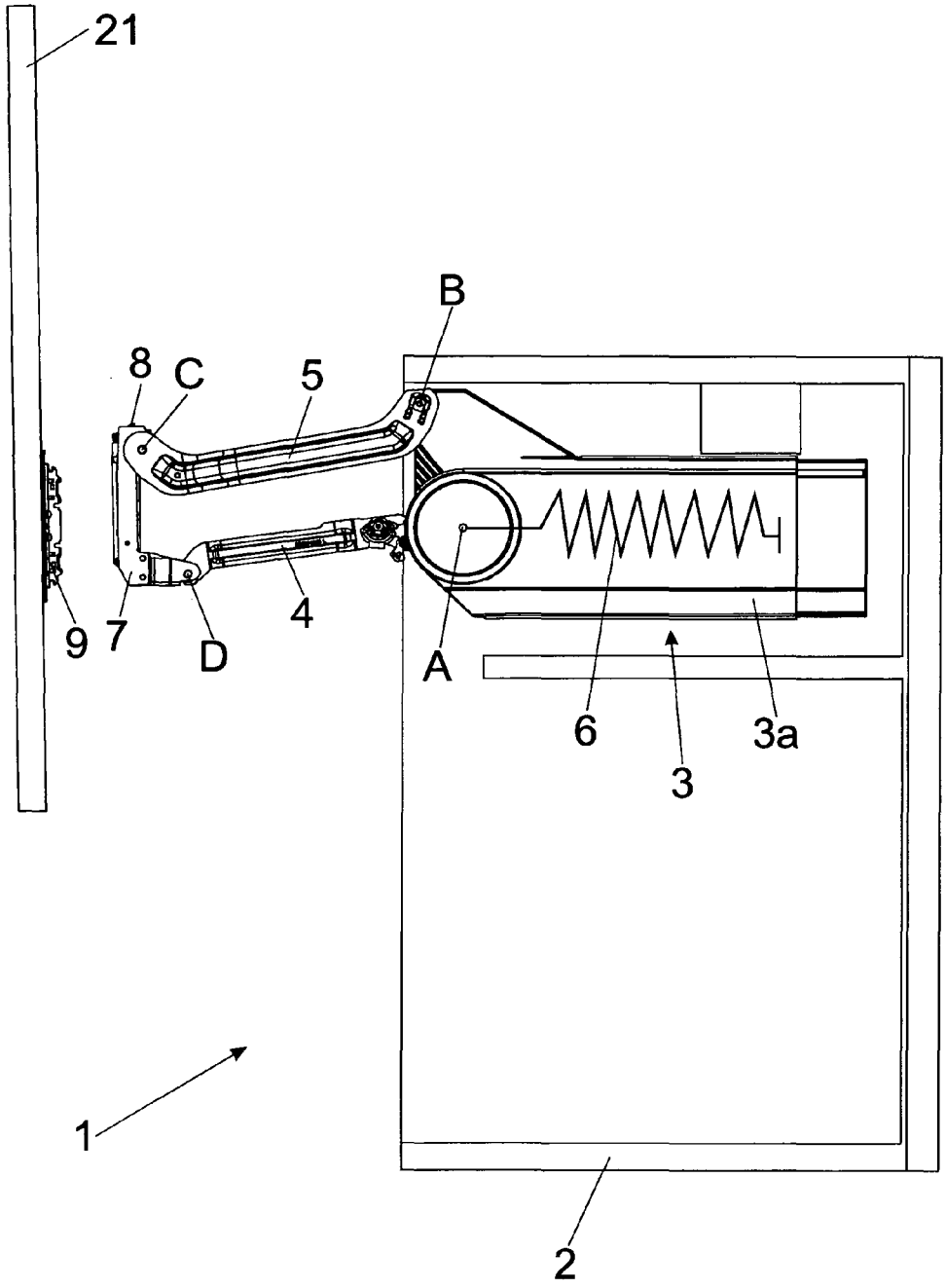
FIG. 1 shows a side view of an embodiment of an actuating drive mounted to the furniture carcass, wherein a furniture flap is to be connected to the actuating arm.

FIG. 1 shows a diagrammatic side view of an article of furniture 1 in cupboard form with a furniture carcass 2, wherein an actuating drive 3 for moving a movable furniture part 21 in the form of a flap is mounted to the side wall of the furniture carcass 2. The actuating drive 3 has a main body 3*a* to be fixed to the furniture carcass 2, wherein, in the illustrated embodiment, two actuating arms 4 and 5 are mounted to or in that main body 3*a* pivotally about a horizontal axis of rotation A, B. The Figure diagrammatically indicates a spring device 6 which urges the lower actuating arm 4 about the axis of rotation A in the opening direction. In addition, the actuating drive 3 has a mounting portion 7 hingedly connected to the two actuating arms 4, 5 by way of pivot bearings C, D at the flap side. The mounting portion 7 has a fixing device 8 (for example in the form of a snap-action connection), by which the mounting portion 7 can be releasably latched to a fitment body 9 pre-mounted to the flap 21. In the illustrated mounting situation, the two actuating arms 4 and 5 can be urged in the closing direction against the force of the spring device 6. However, there is also the risk that the actuating arms 4, 5 will move suddenly and violently in an uncontrolled manner again into the fully open position due to the spring device 6 acting thereon, and in so doing can cause serious injuries or damage. For that purpose, the mounting portion 7 has a locking device (not visible here), by which at least one of the two pivot bearings C, D can be blocked. The mounting portion 7 is firstly fixed relative to the two actuating arms 4, 5 by the possibility of locking a pivot bearing C, D. As however the two actuating arms 4, 5, together with the axes of rotation A, B at the carcass side and the pivot bearings C, D at the flap side, form a four-pivot chain, locking a single pivot bearing C, D provides that the two actuating arms 4, 5 can also be prevented from a pivotal movement. In that way, the flap 21 can be fixed with its fitment body 9 without any problem to the mounting portion 7 which is secured in position, while in addition the two actuating arms 4, 5 are also fixed in their pivotal position and cannot be displaced against the force of the spring device 9.

Figure 2A:
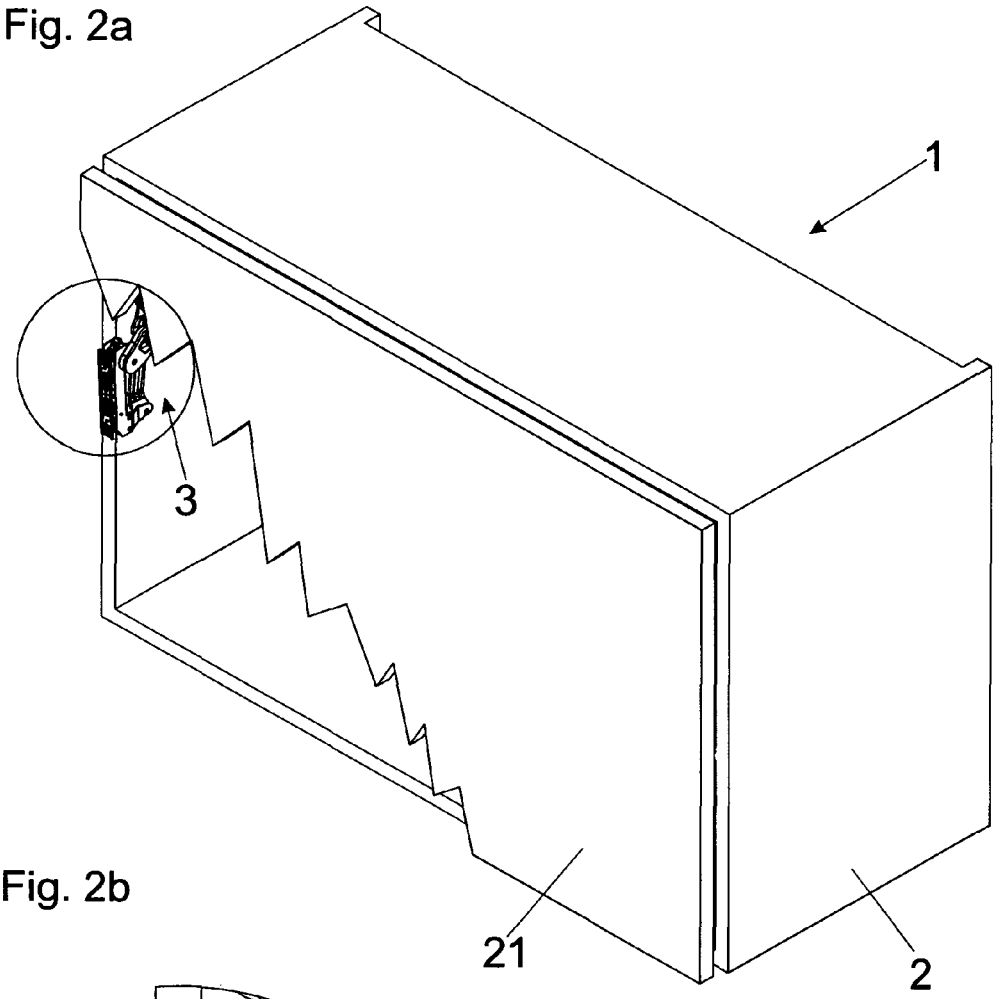
FIGS. 2*a*, 2*b* show a perspective view of an article of furniture with an upwardly movably mounted furniture flap in a partly broken-away view and an enlarged detail view thereof.
Figure 2B:
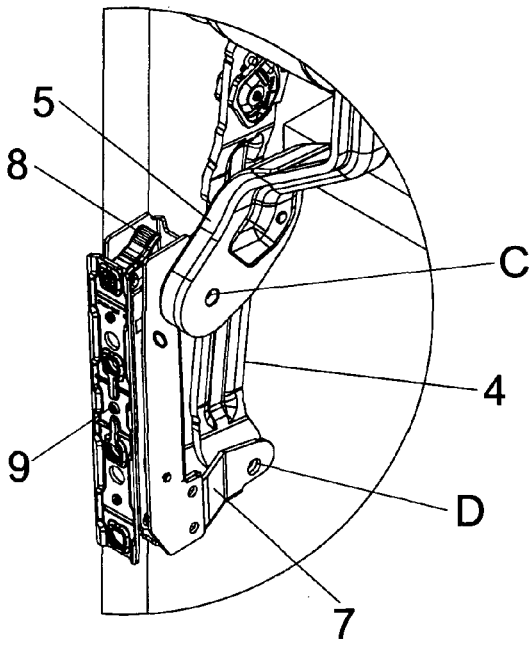

FIG. 2*a* shows a perspective view of the article of furniture 1 with the furniture carcass 2, wherein the flap 21 is mounted movably in respect of height relative to the stationary furniture carcass 2 by way of at least one actuating drive 3. FIG. 2*b* shows a view on an enlarged scale of the region circled in FIG. 2*a*. It is possible to see in FIG. 2*b* the two ends of the actuating arms 4, 5 hingedly connected to the mounting portion 7 by way of the pivot bearings C and D. The flap 21 is shown as being cut out in the illustrated view, wherein the fitment body 9 to be fixed to the flap 21 is already connected to the mounting portion 7 by way of the fixing device 8. As is already known per se, the fixing device 8 has a spring-loaded latching portion which is automatically latchable to the fitment body 9 when the flap is mounted in position. By manually applying pressure to the fixing device 8, the connection between the fitment body 9 and the mounting portion 7 can be released again, whereby the flap 21 can also be completely removed from the actuating arm 4.

Figure 3:
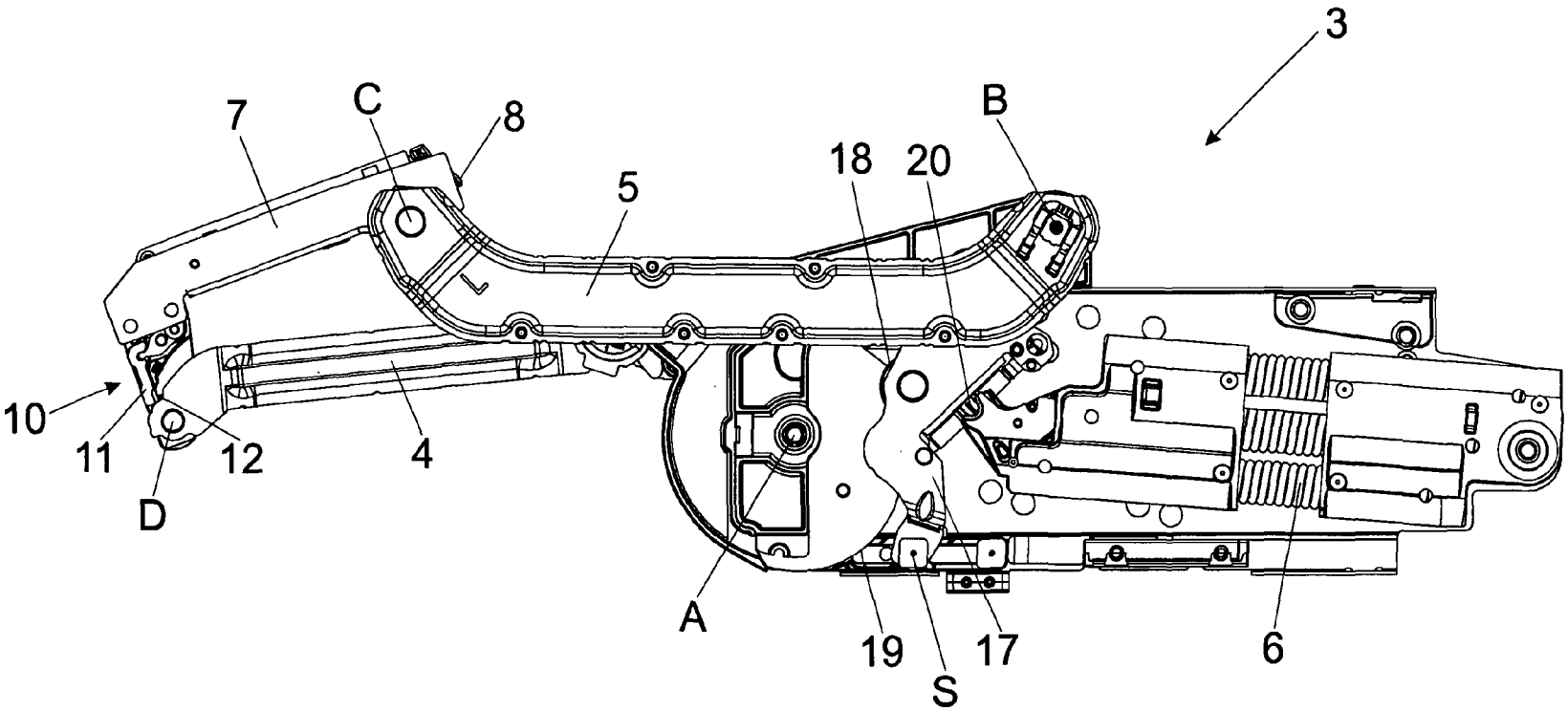
FIG. 3 shows a side view of the actuating drive to be mounted to the furniture carcass.

FIG. 3 shows a side view of the actuating drive 3. The spring device 6 pressurizes the lower actuating arm 4 in the opening direction about the axis of rotation A. As can be seen from the illustrated embodiment, the spring device 6 can act on an intermediate lever 17 mounted pivotably about the axis of rotation S, wherein the spring-loaded intermediate lever 17 pivots the actuating arm 4 by way of a pressure roller 18 and an actuating contour 19. In addition, the actuating drive 3 has an adjusting device 20 so that the force of the spring device 6 acting on the actuating arm 4 is variably adjustable. In that way, the produced torque of the spring device 6, acting on the actuating arm 4, can be appropriately adapted to the weight of the flap 21 to be moved. Reference 10 generally identifies a locking device by which the pivot bearing D connecting the actuating arm 4 and the mounting portion 7 is lockable. It is also possible to see a movably mounted locking portion 11 which engages into a recess 12 in the actuating arm 4 in the illustrated locked position. In that way, the mounting portion 7 is fixed relative to the two actuating arms 4, 5, wherein the actuating arms 4, are also locked in their relative pivotal position relative to the furniture carcass 2.

Figure 4A:
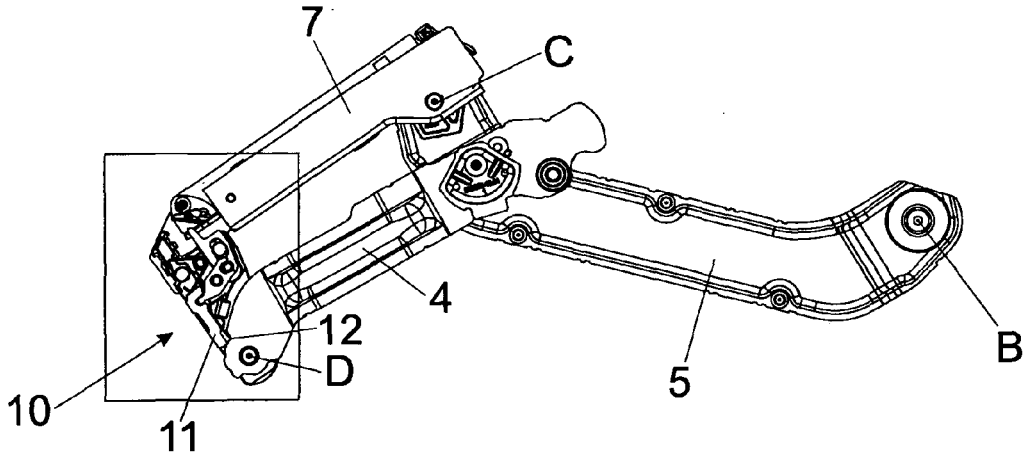
FIGS. 4*a*, 4*b* show the locking device in a release position and an enlarged detail view thereof.
Figure 4B:
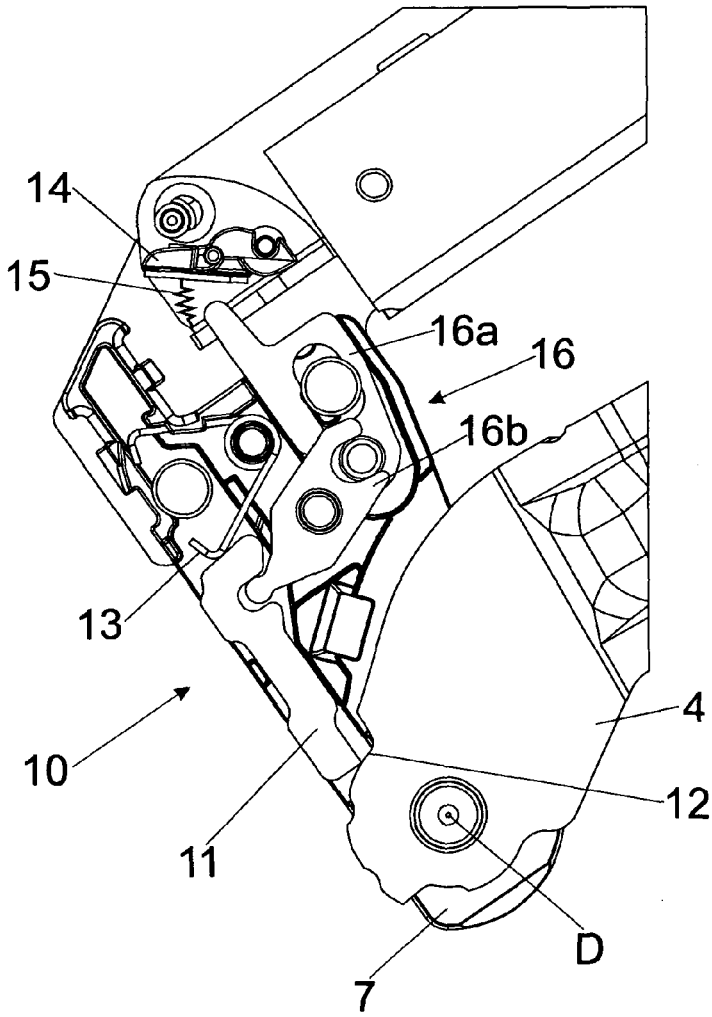

FIG. 4*a* shows a side view of the two actuating arms 4, 5 with the locking device 10, while FIG. 4*b* shows a view on an enlarged scale of the region identified in FIG. 4*a*. FIG. 4*b* shows the locking device 10 in a position of locking the actuating arm 4. It is possible to see a movably mounted locking portion 11 which, in the illustrated Figure, engages into a recess 12 of the actuating arm 4 so that the locking portion 11 is pushed into the rotary path of the actuating arm 4. It can also be seen from this view that the mounting portion 7 is fixed in the locked position with a predetermined play relative to the actuating arm 4, whereby attaching the fitment body 9 which has been pre-mounted to the flap 21 to the mounting portion 7 is simplified. It is also possible to see a spring 13 in the form of a leg spring which constantly urges the displaceably mounted locking portion 11 in the direction of the locking position. The locking device 10 includes a movably, preferably pivotably, mounted control portion 14 being pre-stressed by a diagrammatically illustrated spring element 15. There is also a transmission mechanism 16 whereby a movement of the control portion 14 can be transmitted to the locking portion 11. In the illustrated embodiment, the transmission mechanism 16 includes two levers 16*a* and 16*b* hingedly connected together. The pivotable lever 16*b* is in the form of a two-armed lever, wherein one end thereof is connected to the lever 16*a* and the other end to the locking portion 11. As long as the fitment body 9 pre-mounted to the flap 21 is not coupled to the mounting portion 7, the locking mechanism 10 remains in a position of locking the actuating arm 4. If, however, the control portion 14 is contacted by the fitment body 9 when mounting the flap in position, the control portion 14 is pivoted in opposition to the force of the spring element 15. That pivotal movement of the control portion 14 also leads to a movement of the levers 16*a* and 16*b*, whereby the locking portion 11 is also withdrawn from the actuating arm 4 (from recess 12) against the force of the spring 13.

Figure 5A:
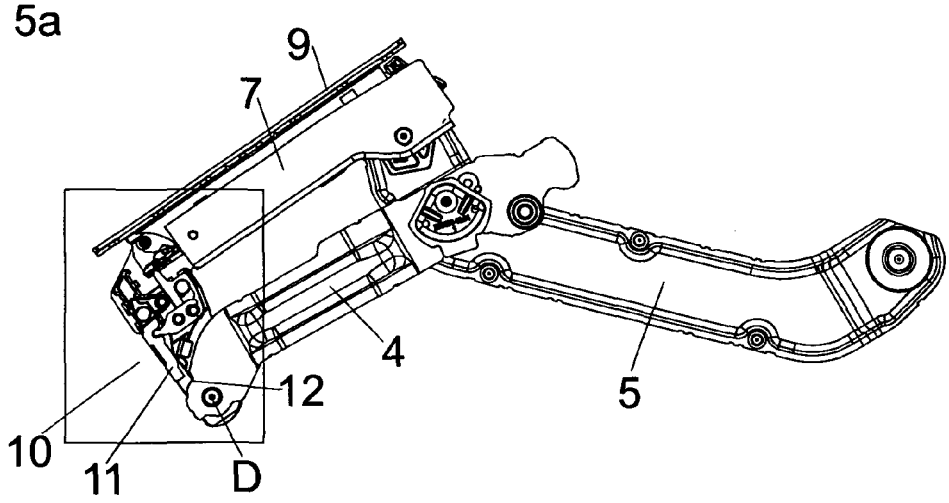
FIGS. 5*a*, 5*b* show the locking device in the locking position and an enlarged detail view thereof.
Figure 5B:
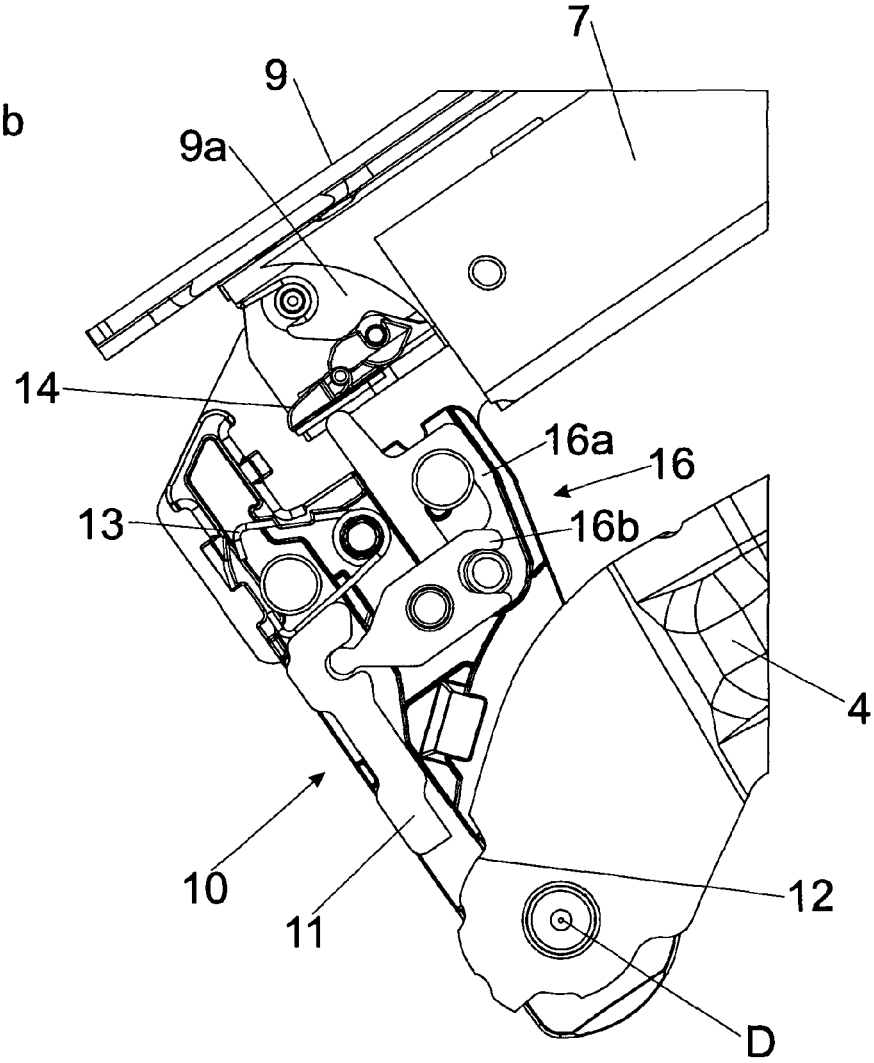

FIG. 5*a* shows the situation in which the fitment body 9 associated with the flap 21 has been properly connected to the mounting portion 7. The flap 21 connected to the fitment body 9 has been cut out, for reasons of clarity of the drawing. FIG. 5*b* shows a view on an enlarged scale of the region identified in FIG. 5*a*. The fitment body 9 has an abutment portion 9*a* which has pivoted the control portion 14 when mounting the flap in position. That movement of the control portion 14 has led to a linear movement of the first lever 16*a*, a pivotal movement of the second lever 16*b* and finally a resulting linear movement of the locking portion 11 so that the locking portion 11 has been withdrawn from the recess 12 in the actuating arm 4. The actuating arm 4 is thus freely movable for the movements which are usually provided for the flap 21. The indentations provided beside the recess 12 at the peripheral edge of the actuating arm 4 serve preferably not for locking purposes, but so as to allow free movement of the actuating arm 4 so that it does not collide with the locking portion 11 during normal handling of the flap 21. In the situation where the fitment body 9 is removed from the mounting portion 7 again, the locking portion 11 will be immediately urged into the locking position again by the force of the spring 13 even in a resting status of the arm 4 (i.e., will lock the arm 4 even if the arm 4 is not moving at the time). Thus, the actuating arm 4 is again locked in an open position. In addition, the control portion 14 is lifted off the first lever 16*a* again by the spring element 15 shown in FIG. 4*b* and is moved into a readiness position.

The present invention is not limited to the illustrated embodiment, and includes or extends to all variants and technical equivalents which can fall within the scope of the appended claims. The positional references adopted in the description such as for example 'up', 'down', 'lateral' and so forth are also related to the usual position of installation of the components used and the illustrated Figure and are to be appropriately transferred to the new position upon a change in position.

The invention claimed is:

1. An actuating drive comprising:

an actuating arm for moving a movable furniture part, said actuating arm having a mounting portion;

a locking device for locking a movement of said actuating arm, said locking device being configured to allow a movement of said actuating arm only after the movable furniture part has been mounted to said actuating arm, and said locking device being configured such that unlocking of said locking device is automatically effected by mounting of the movable furniture part to said actuating arm;

a fitment body to be fixed to the movable furniture part; and a fixing device for releasably connecting said mounting portion of said actuating arm to said fitment body;

wherein said locking device includes:

a movably-mounted control portion;

a locking portion for blocking a pivotal movement of said actuating arm; and a transmission mechanism for transmitting movement of said control portion to said locking portion so as to block and unblock the pivotal movement of said actuating arm;

wherein said control portion of said locking device and said fitment body are configured such that, upon mounting of said mounting portion to said fitment body, said control portion is acted upon by said fitment body.

2. The actuating drive according to claim 1, wherein said transmission mechanism is configured to convert a pivotal movement of said control portion into a linear movement of said locking portion.

3. The actuating drive according to claim 1, wherein said transmission mechanism includes at least two hingedly interconnected levers.

4. The actuating drive according to claim 1, wherein said locking device further includes a spring configured to urge said locking portion in a blocking direction.

5. The actuating drive according to claim 1, wherein said actuating arm has a recess into which said locking engages to block the pivotal movement of said actuating arm.

6. The actuating drive according to claim 1, wherein said fixing device is configured to releasably connect said mounting portion of said actuating arm to said fitment body without a tool.

7. An actuating drive comprising:

a fitment body to be fixed to a movable furniture part;

an actuating arm for moving the movable furniture part, said actuating arm having a mounting portion releasably connected to said fitment body; and a locking device for locking said actuating arm so as to prevent a movement of said actuating arm, and for unlocking said actuating arm so as to allow a movement of said actuating arm, said locking device being configured to automatically lock said actuating arm when said fitment body is disconnected from said mounting portion of said actuating arm, and said locking device being configured to automatically unlock said actuating arm when said fitment body is connected to said mounting portion of said actuating arm, said locking device including:

a movably-mounted control portion to be contacted by said fitment body;

a locking portion for blocking a pivotal movement of said actuating arm; and a transmission mechanism for transmitting movement of said control portion to said locking portion so as to block and unblock the pivotal movement of said actuating arm.

8. The actuating drive according to claim 7, wherein said locking device further includes a spring for urging said locking portion in a locking direction of said actuating arm.

9. The actuating drive according to claim 7, further comprising a fixing device for releasably connecting said mounting portion to said fitment body.

10. The actuating drive according to claim 9, wherein said mounting portion is pivotably connected to said actuating arm by a pivot bearing.

11. The actuating drive according to claim 9, wherein said movably-mounted control portion is to be acted on by said fitment body upon mounting of said mounting portion to said fitment body.

12. The actuating drive according to claim 11, further comprising a spring element for pre-stressing said control portion.

13. The actuating drive according to claim 11, wherein said control portion is pivotably mounted.

14. The actuating drive according to claim 9, wherein said fixing device is configured to releasably connect said mounting portion of said actuating arm to said fitment body without a tool.

15. The actuating drive according to claim 7, wherein said actuating arm is configured to be locked by said locking device in an open position in which said actuating arm holds the movable furniture part in an open position.

16. The actuating drive according to claim 7, wherein said actuating drive has a main body to be fixed to a furniture carcass, said actuating arm to be pivotably mounted to the furniture carcass about a horizontal axis of rotation.

17. The actuating drive according to claim 16, further comprising a spring device for urging said actuating arm in an opening direction about the horizontal axis of rotation so as to thereby urge the movable furniture part toward an open position.

18. The actuating drive according to claim 7, wherein said actuating arm comprises a first actuating arm of at least two actuating arms for moving the movable furniture part.

19. An article of furniture comprising:

a movable furniture part; and an actuating drive including:

a fitment body fixed to said movable furniture part;

an actuating arm for moving said movable furniture part, said actuating arm having a mounting portion releasably connected to said fitment body; and a locking device for locking said actuating arm so as to prevent movement of said actuating arm, and for unlocking said actuating arm so as to allow a movement of said actuating arm, said locking device being configured to automatically lock said actuating arm when said fitment body is disconnected from said mounting portion of said actuating arm, and said locking device being configured to automatically unlock said actuating arm when said fitment body is connected to said mounting portion of said actuating arm, locking device including:

a movably-mounted control portion to be contacted by said fitment body;

a locking portion for blocking a pivotal movement of said actuating arm; and a transmission mechanism for transmitting movement of said control portion to said locking portion so as to block and unblock the pivotal movement of said actuating arm;

wherein said actuating drive is releasably mounted to said movable furniture part.

* * * * *